United States Patent [19]

DeMars

[11] Patent Number: 4,918,290

[45] Date of Patent: Apr. 17, 1990

[54] PORTABLE TOWEL HEATING DEVICE

[76] Inventor: Robert A. DeMars, 7932 Maestro, Canoga Park, Calif. 91304

[21] Appl. No.: 96,727

[22] Filed: Sep. 14, 1987

Related U.S. Application Data

[63] Continuation of Ser. No. 791,726, Oct. 28, 1985, abandoned.

[51] Int. Cl.[4] ..... F27D 7/04; F26B 9/06

[52] U.S. Cl. ..... 219/400; 219/386; 219/521; 34/202; 34/233

[58] Field of Search ..... 219/400, 385, 386, 214, 219/521; 34/233, 151, 163, 202, 218, 219, 224, 225

[56] References Cited

U.S. PATENT DOCUMENTS

| | | | |
|---|---|---|---|
| 1,943,575 | 1/1934 | Abendroth | 219/386 |
| 2,005,501 | 6/1935 | Kelly | 219/400 |
| 2,412,407 | 12/1946 | Kilbury | 219/400 |
| 2,561,517 | 7/1951 | Ladge | 34/219 |
| 2,959,870 | 11/1960 | Vandercook | 34/151 |
| 3,545,832 | 12/1970 | Levenback | 219/400 |
| 3,577,650 | 5/1971 | Brahm | 34/233 |
| 4,224,743 | 9/1980 | Erickson | 34/219 |
| 4,644,136 | 2/1987 | Watchman | 219/385 |

FOREIGN PATENT DOCUMENTS

| | | | |
|---|---|---|---|
| 1238937 | 7/1960 | France | 34/151 |
| 8303304 | 4/1985 | Netherlands | 34/202 |
| 325391 | 12/1957 | Switzerland | 219/385 |

*Primary Examiner*—E. A. Goldberg
*Assistant Examiner*—Teresa J. Walberg
*Attorney, Agent, or Firm*—Cislo & Thomas

[57] ABSTRACT

A portable heating device includes a cabinet, a source of heat, support for a towel so as to exposed the towel to the heat, and an opening at the top to the heat. The towel heating device of the invention may be used to warm or dry towels or other like cloth materials.

8 Claims, 2 Drawing Sheets

PORTABLE TOWEL HEATING DEVICE

CROSS-REFERENCE TO RELATED APPLICATION

The present application is a Continuation Applicant of application Ser. No. 06/791,726, filed Oct. 28, 1985 (now abandoned).

BACKGROUND OF THE INVENTION

The present invention relates to apparatus for heating a towel or other cloth material, and, more particularly, to such apparatus having portability.

The feel of a warm towel against the skin immediately after a shower is a delight that, unfortunately, is only rarely enjoyed. If enjoyed in one's home, it is only because one has manged to complete one's shower shortly after having run a load of towels through the washer and dryer. Enjoyment of the pleasure is virtually non-existant in most hotels, motels and inns.

Accordingly, a need exists for a portable towel heating device.

OBJECTS AND SUMMARY OF THE INVENTION

It is an object of the present invention to provide a towel heating device.

It is another object of the invention to provide a towel heating device having portability.

It is yet another object of the invention to provide a towel heating device which will heat towels thoroughly, without burning or singeing the towels.

These and further objects of the invention will become more readily apparent upon a consideration of the following commentary taken in conjunction with the drawing.

Briefly, the portable towel heating device of the invention comprises a cabinet, a source of heat within the cabinet for providing a flow of heated air, means for supporting a towel within the cabinet, means for directing the flow of heated air around and through the towel, and means for exhausting the heat from the cabinet.

DETAILED DESCRIPTION OF PREFERRED EMBODIMENTS

Figure 1:
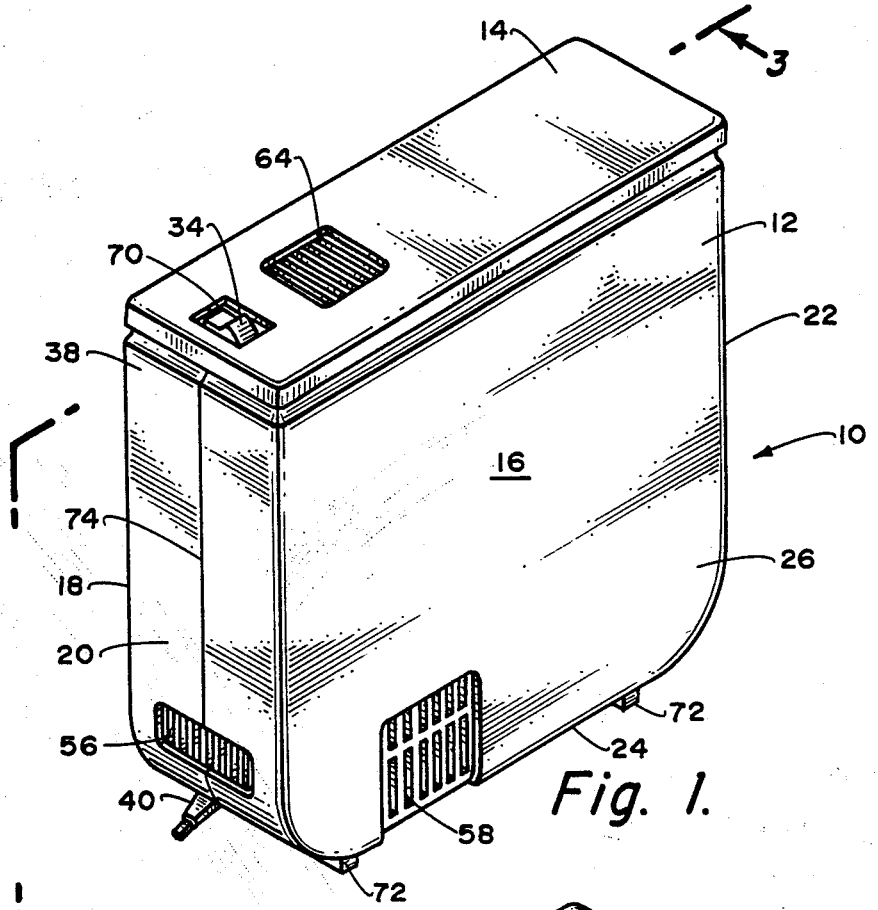
FIG. 1 is a perspective view of the portable towel heating device of the invention.

Referring now to the drawing where like numerals of reference refer to like elements throughout, the towel heating device of the invention is depicted generally at 10.

The towel heating device comprises a cabinet 12 having a top 14, a front 16, rear 18, sides 20, 22 and a bottom 24. In the bottom portion 26 of the cabinet 12 is provided a source of heat 28. Conveniently, the source of heat 28 comprises a blower 30 for generating a flow of heated air, provided with a source of power as by an AC cord 32 which may be retractable into the interior of the cabinet 12 when not in use. A switch 34, connected by electrical cable 36, is mounted in a support bracket 37 in the upper portion 38 of the cabinet 12 for convenience in turning the blower 30 on and off. An optional thermostat 35 senses the temperatures of the heated air and automatically shuts off the blower 30 if the temperature inside the cabinet 12 becomes too hot. Advantageously, a sensing temperature of about 140° to 150° F. is employed. A timer (not shown) may also be employed in connection with the invention. A protective covering 40, which includes a grommet for passing the AC cord 32 into the interior of the cabinet 12, conveniently protects the AC cord 32 from fraying and undue stress.

The upper portion 38 of the cabinet 12 includes a means 42 for supporting a towel 44 (shown in phantom). Preferably, the support member 432 comprises a perforated material, such as a wire mesh screen, to permit hot air enanating from the blower 30 to circulate around and through the towel 44. As shown by the arrows in FIG. 3, hot air generated by the blower 30 is deflected by a deflector 46 through the supporting member 42 and through and around the towel 44. A cover 48 is provided over the top of the blower 30 in order to provide a heat shield and thus prevent overheating of the blower 30 as a result of the presence of hot air in the cabinet 12.

A compartment 50 for the towel 32 is provided to retain the towel such that it does not interfere with the wire 36 or totally block the exit of the hot air emanating from the blower 30. The compartment 50 is defined by the front 16 and rear 18 of the cabinet, top 14, a cable channel cover 52 and a perforated plate 54, such as a wire mesh screen.

The cabinet 12 is provided with a number of openings 56, 58, 60, 62 in the side 20, front 16, rear 18 and the bottom 24, respectively, of the cabinet 12 in order to provide a supply of air for heating as well as to provide a supply of air for cooling the blower motor itself.

Figure 2:
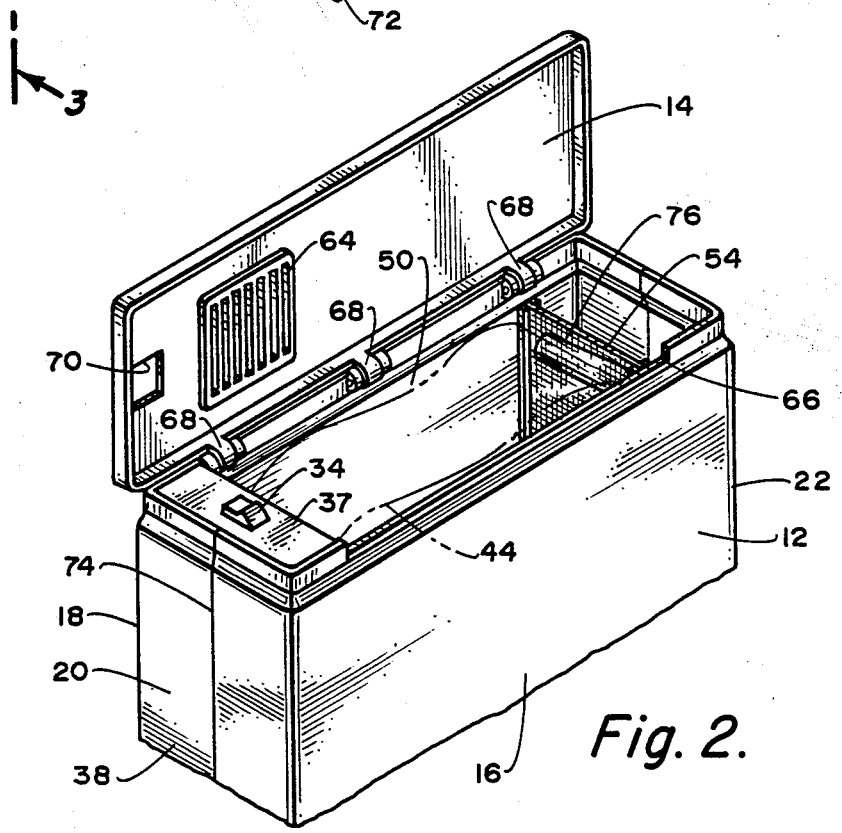
FIG. 2 is a fragmentary view of the top portion of the portable towel heating device of the invention, with the top panel shown in the open position to permit depicting the inside of the device.
Figure 4:
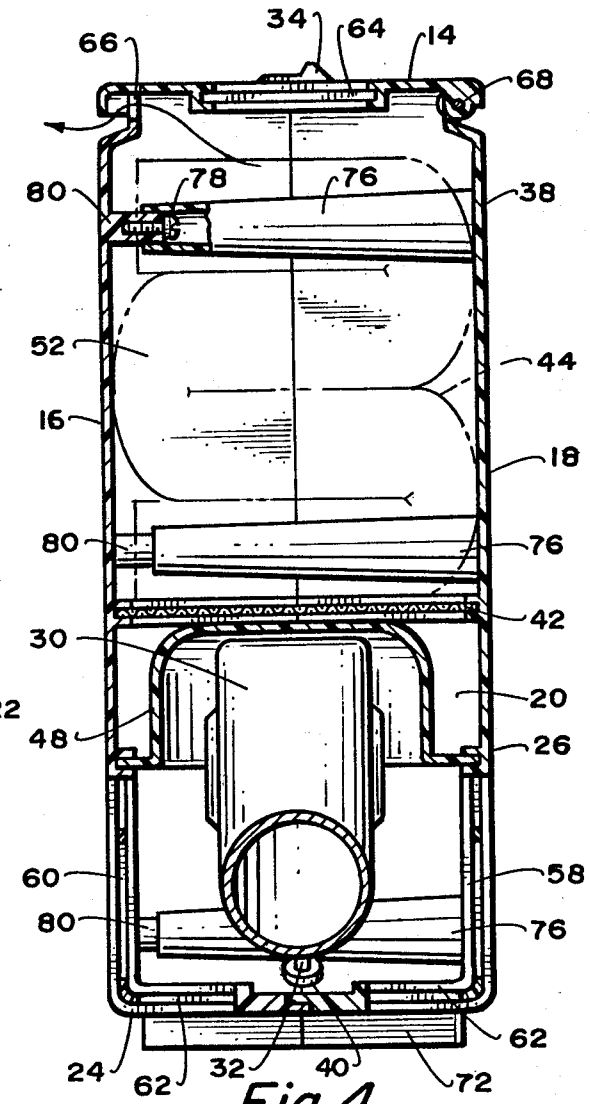
FIG. 4 is a cross-sectional view taken along the line 4—4 of FIG. 3.

To permit the heated air to escape, an opening 64 is provided in the top 14 of the cabinet 12. Further, a portion of the cabinet 12 is cut away along the top of the front 16, as shown in FIG. 2 in a area designated 66, to also permit the hot air to escape.

The top cover 14 is provided with hinges 68 to permit easy opening and closing of the cover 14. An opening 70 accomodates the switch 34.

The bottom of the cabinet 12 is provided with supports 72 for permitting air to enter the opening 62 and to prevent undue stress on the AC line 32.

The front 16 and rear 18 are conveniently maintained in spaced apart relation along mating surfaces indicated at 74 using spacers 76 attached by screws 78 to blind threaded bosses 80.

Figure 3:
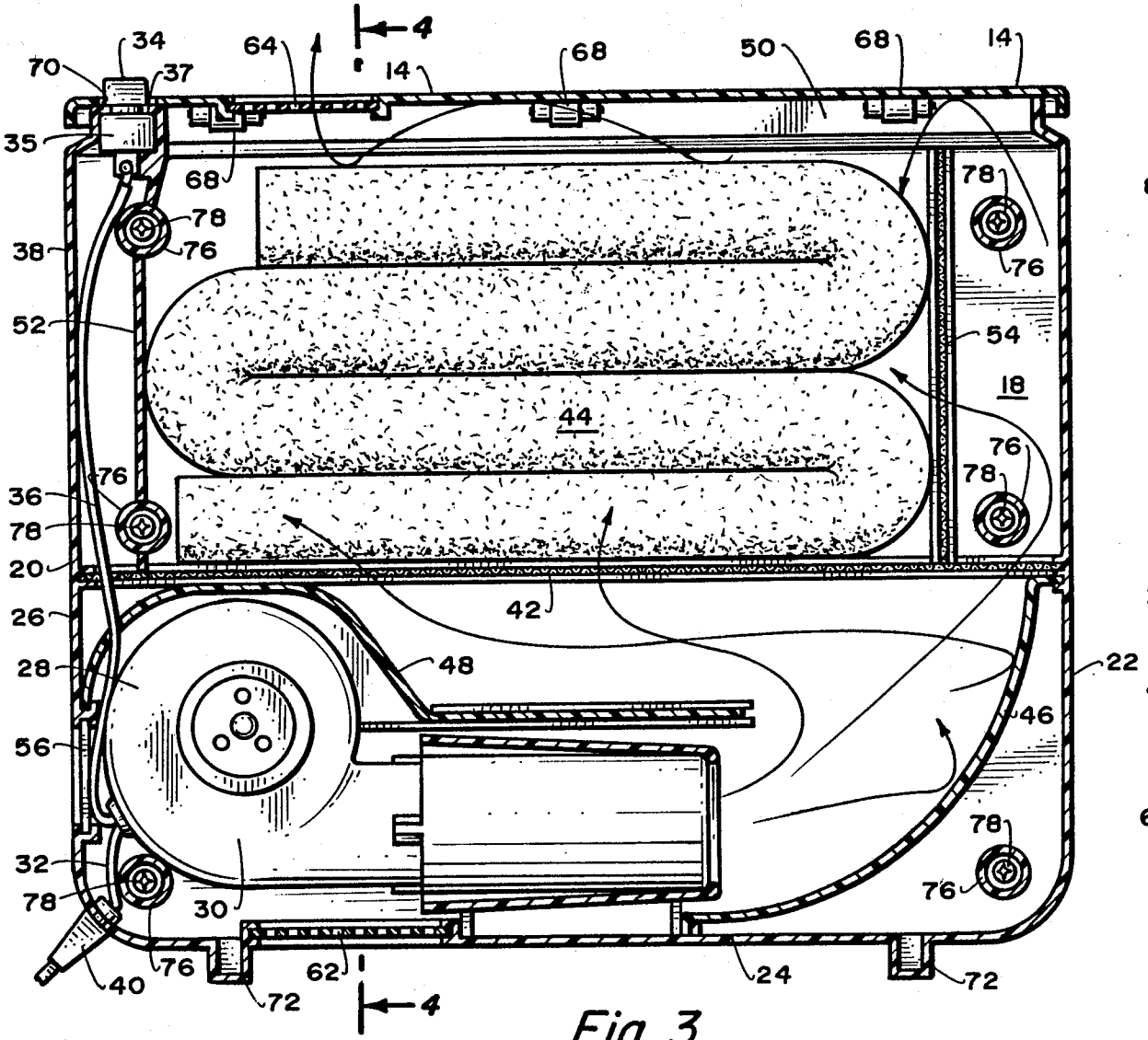
FIG. 3 is a cross-sectional view taken along the line 3—3 of FIG. 1.

As best seen in FIG. 3, during the operation of the towel heating device of the invention, air heated by the blower 30 emerges from the end thereof and is directed against deflector plate 46 upward to flow around and through the towel 44 as supported in place by the wire mesh screens 42 and 54. The heated air then escapes through the top 14 of the cabinet 12 as described above.

It will be seen that the device of the invention is easily transportable and hence may be taken on trips. The cabinet may comprise a lightweight material, such as a plastic capable of withstanding the temperatures generated by the source of heat 28. The dimensions of the cabinet are such as to contain one bath towel 44, the blower 30 and additional slight spacing for the wire 36 and to permit hot air to pass around the towel 44.

While towels such as shown at 44 may be heated by the device of the invention, other cloth material may also be heated if desired, and, of course, the device of the invention may be used in drying various small articles. This, of course, would be of considerable aid in a hotel for the traveler wishing to do minor laundry in his room.

Thus, there has been disclosed a towel heating device having portability and capable of warming towels to an elevated temperature. Various modifications and changes which are obvious will occur to the person skilled in the art, and all such changes and modifications are intended to be covered by the invention as defined by the appended claims.

What is claimed is:

1. An easily transportable towel heating device comprising (a) a cabinet made of heat-resistant, lightweight material, said cabinet having a front, rear, two sides, bottom, and a hingedly mounted accessible top;

(b) an electrically operated blower-heater located in a bottom portion of said cabinet for providing a flow of heated air substantially parallel to the front of said cabinet;

(c) perforated means for supporting a towel in said cabinet above said blower-heater and for allowing intersecting air flows;

(d) a deflector located in the flow of heated air for directing said flow of heated air substantially perpendicular to the front of said cabinet around and through said towel; and (e) means for exhausting said heated air from an upper end of said cabinet.

2. The device of claim 1 in which said cabinet has openings in the lower portion of said cabinet to provide a supply for heating in said blower-heater of air for cooling said blower-heater.

3. The device of claim 2 wherein a switch is accessible through the top of said cabinet for turning said blower on and off.

4. The device of claim 3 further including a heat shield for protecting said blower from said heated air.

5. The device of claim 1 wherein aid perforated means comprises a wire mesh screen.

6. An easily transportable portable towel heating device comprising:

(a) a cabinet made of heat-resistant, lightweight material, said cabinet having a front, rear, two sides, bottom, and a hingedly mounted accessible top, as well as an upper portion and a lower portion;

(b) an electrically operated blower-heater in said lower portion of said cabinet for providing a flow of heated air substantially parallel to the front of said cabinet;

(c) openings in said lower portion of said cabinet for providing a supply of air to be heated and to cool said blower;

(d) perforated means in the upper portion of said cabinet for supporting a towel in said cabinet above said blower-heater and for allowing intersection air flows;

(e) a deflector located in the flow of heated air for directing said flow of air substantially perpendicular to the front of said cabinet around and through said towel; and (f) openings in said upper portion of said cabinet for exhausting said heated air from said cabinet.

7. The device of claim 6 wherein the perforated means comprises a wire mesh screen.

8. A device of claim 7 wherein the dimension of the cabinet are such as to contain one towel in the upper portion.

* * * * *